United States Patent [19]

Matsuda et al.

[11] Patent Number: 5,060,466

[45] Date of Patent: Oct. 29, 1991

[54] COMPOSITE ROPE AND MANUFACTURING METHOD FOR THE SAME

[75] Inventors: Shigeharu Matsuda, Ebina; Hiroshi Takaki, Tsuchiura; Hiroshi Kimura, Ooazashimoinayoshi, all of Japan

[73] Assignee: Tokyo Rope Mfg. Co. Ltd., Tokyo, Japan

[21] Appl. No.: 427,171

[22] Filed: Oct. 25, 1989

[30] Foreign Application Priority Data

Oct. 31, 1988 [JP] Japan ..... 63-275623

[51] Int. Cl.[5] ..... D02G 3/36; D02G 3/40

[52] U.S. Cl. ..... 57/7; 57/12; 57/211; 57/232; 57/297

[58] Field of Search ..... 57/210, 211, 232, 234, 57/3, 7, 13, 14, 295, 297, 12

[56] References Cited

U.S. PATENT DOCUMENTS

| | | | |
|---|---|---|---|
| 3,405,516 | 10/1968 | Laureti | 57/211 |
| 3,857,229 | 12/1974 | Marzocchi | 57/234 X |
| 4,050,230 | 9/1977 | Senoo et al. . | |
| 4,228,641 | 10/1980 | O'Neil | 57/7 X |
| 4,250,702 | 2/1981 | Gundlach | 57/297 X |
| 4,299,884 | 11/1981 | Payen | 57/3 X |
| 4,430,851 | 2/1984 | Sundet | 57/211 |
| 4,677,818 | 7/1987 | Honda et al. | 57/224 |

FOREIGN PATENT DOCUMENTS

| | | |
|---|---|---|
| 0082067 | 12/1982 | European Pat. Off. . |
| 57-25679 | 5/1982 | Japan . |
| 61-28092 | 2/1986 | Japan . |

*Primary Examiner*—Joseph J. Hail, III

*Attorney, Agent, or Firm*—Frishauf, Holtz, Goodman & Woodward

[57] ABSTRACT

A composite rope obtained by process comprising, impregnating a multifilament with epoxy resin and half-setting the resin to form a prepreg, twisting the plural prepregs together to form a primarily-twisted product, and wrapping the primarily-twisted product with a yarn or a porous tape. When it is wound round the primarily-twisted product, the yarn is closely wound at an angle substantially perpendicular to an axis of the primarily-twisted product. The method further comprises twisting the plural primarily-twisted products thus wrapped to form a secondarily-twisted product and then heating the secondarily-twisted product to completely set the resin impregnated.

15 Claims, 6 Drawing Sheets

COMPOSITE ROPE AND MANUFACTURING METHOD FOR THE SAME

BACKGROUND OF THE INVENTION

1. Field of the Invention

The present invention relates to a composite rope suitable for use as the material for reinforcing concrete structures, the rope for holding various equipments on boats and ships and anchoring boats and ships themselves, the material for reinforcing cables not to become loose, the cable for operating cars and air planes, and the material for reinforcing non-magnetic structures. The present invention also relates to a method of manufacturing the composite rope.

2. Description of the Related Art

Japanese Patent Publication Sho 57-25679 discloses a technique of impregnating multifilaments, high tensile strength and low elongation, with a thermo setting resin to prepare a corrosion-resistant composite rope, substantially same in strength and elongation but lighter, as compared with the conventional wire rope.

According to this technique, the multifilaments, high in strength but low in extension, are twisted together, in such a way that their strength-utilizing efficiency becomes higher than 50%, to prepare a primarily-twisted product (e.g. yarn of continuous fiber). The term "strength-utilizing efficiency $\eta$" means a ratio between the tensile strength of a bundle of the multifilaments not twisted and that of the bundle of them twisted. The primarily-twisted product is impregnated with a thermosetting resin, which has been so set as to hold the primarily-twisted product as it is, and then coated at the outer circumference thereof with a thermoplastic resin. Plural products thus formed are twisted or laid together to prepare a secondarily-twisted product (e.g. cable). This secondarily-twisted or -laid product is heated to set the impregnated resin and to provide a composite rope.

The reason why the primarily-twisted product is coated with thermoplastic resin resides in enhancing the forming ability of the composite rope and protecting the rope.

According to the above-described technique, the primarily-twisted product is impregnated with thermosetting resin and then coated at the outer circumference with thermoplastic resin. Therefore, the coating resin makes the inside of the primarily-twisted product airtight, causing air to be caught in it in the course of impregnating and coating it with resins. Further, volatile gas caused when the thermosetting resin is heated and a part of solvent in the resin are caught and left in it. These air, gas and solvent are present as voids in it, causing the composite rope, which is the final product, to become low in mechanical property.

U.S. Pat. No. 4,677,818 discloses another technique of eliminating the above-mentioned drawbacks to prepare a composite rope, higher in strength and lower in extension.

According to this second technique, the primarily-twisted product which has been impregnated with resin is attached by smoothing powder (or talc) and further wrapped at the outer circumference thereof by a woven fabric (cloth). And the primarily-twisted product thus wrapped by the cloth is heated to set the impregnating resin. Air, gas and solvent caught in the primarily-twisted product can be thus escaped through meshes of the cloth, thereby enabling no void to be left in the primarily-twisted product.

However, the cloth is formed by fibers woven together. Therefore, the thickness of the cloth wrapped round the primarily-twisted product becomes theoretically two times the diameter of the fiber woven and it sometimes reaches 0.5 mm in the thickest. When the primarily-twisted product is wrapped by the cloth, therefore, its diameter becomes large and this makes it impossible to prepare a compact composite rope.

SUMMARY OF THE INVENTION

The object of the present invention is therefore to provide a compact composite rope, high tensile strength and low elongation.

According to an aspect of the present invention, a composite rope is prepared by a process comprising impregnating multifilaments with a thermo setting resin, half-setting the thermosetting resin to form prepregs, twisting plural prepregs to form a primarily-twisted product, closely winding a filament or a yarn round the primarily-twisted product in a direction substantially perpendicular to the longitudinal axis of the product, twisting plural primarily-twisted products, each of which has been wound by the filament or yarn, to form a secondarily-twisted product, and heating the a secondarily-twisted product to set the resin impregnated.

Various kinds of organic or inorganic filaments can be used as the winding (or coating) one, but it is preferable to use a yarn of those filaments made of particularly polyester, polyamide (e.g. Aramide) or carbon.

It is also preferable that the winding yarn has a filament diameter of 5–50 $\mu$m and that the size of the yarn wound is in a range of 2000–15000 denier. When it becomes smaller than 2000 denier, the speed of winding the yarn round the primarily-twisted product is reduced, resulting in low productivity, while when it becomes larger than 15000 denier, the yarn cannot be closely wound round the product. 1 denier is a unit representing the size of that multifilament which has a length of 9000 m and a weigth of 1 gram.

A porous tape may be wound or coated round the primarily-twisted product instead. It is preferable in this case that the thickness of the porous tape is in a range of 0.01–0.30 mm. When it becomes smaller than 0.01 mm, the porous tape is likely to be broken while being wound round the product and when it becomes larger than 0.30 mm, the tape makes the diameter of the product unnecessarily large.

Various kinds of organic or inorganic filaments can be used as the prepreg-forming multifilament, and it is preferable to use filaments made of particularly polyester, polyamide (e.g. Aramide), glass, silicon carbide or carbon. The diameter of the filament is preferably in a range of 5–40 $\mu$m, more preferably about 7 $\mu$m.

It is preferable that the sectional area of the whole multifilaments which are not treated to form the prepreg yet is smaller than 2.0 $mm^2$. This is because the resin cannot easily enter into the multifilaments when the sectional area of the whole multifilaments are too large.

It is preferable that the ratio of the thermosetting resin impregnated is in a range of 25–60 volume %. When the diameter of the primarily-twisted product is to be made smaller, it is usually desirable that the ratio of the thermosetting resin impregnated is made as small as possible. When the ratio of the impregnated resin is smaller than 25 volume %, however, it becomes difficult for the resin to fully enter into those filaments which form the multifilament. When it exceeds 60 volume %, prepregs become too soft to be rightly twisted together.

It is desirable that epoxy resin, unsaturated polyester resin, polyimide resin or bismaleimide resin is used as the thermosetting resin.

According to another aspect of the present invention, there can be provided a method of manufacturing the composite rope comprising impregnating multifilaments with a thermosetting resin and half-setting the impregnated resin to form prepregs, twisting the plural prepregs to form a primarily-twisted product, winding a yarn or porous tape round the primarily-twisted product to coat the product, twisting the plural primarily-twisted products to form a secondarily-twisted product, and heating the secondarily-twisted product to set the resin impregnated.

The twisting degree of the primarily-twisted product (or composite strand) cannot be defined, using the twisting angle of it. This is because the twisting angle is different inside and on the surface of it. Therefore, the twisting degree is defined here, using ratio "n" of the twisting length relative to the diameter of it.

As apparent from curve E in FIG. 9, strength-utilizing efficiency "$\eta$" quickly reduces to become smaller than 80% when the value of ratio "n" becomes smaller than 8. It is therefore desirable that composite strands are twisted together to make this ratio "n" larger than 8. Curve E in FIG. 9 represents data obtained when fifteen strands of prepregs $12^k$ made of carbon filaments are twisted together to form a primarily-twisted product whose diameter is 4.0 mm.

When angle (or average twisting angle) formed and by the axis of a composite rope by the center axis of one of those primarily-twisted products which have been twisted to form a secondarily-twisted product is assumed to be $\theta$, this angle $\theta$ is preferably larger than 72°, more preferably about 80°. In other words, it is preferable that the primarily-twisted products (or composite strands) are twisted to form a secondarily-twisted product and to make the value of tan $\theta$ larger than 3. This is because strength-utilizing efficiency $\eta$ quickly reduces and becomes smaller than 80% when the value of tan $\theta$ becomes smaller than 3, as apparent from a curve F in FIG. 10. The curve F represents data obtained when a composite rope having a diameter of 12.5 mm is prepared using those primarily-twisted products each of which is twisted at ratio n equal to 21.

When the prepreg is fully dried, it has sufficient smoothness and this makes it unnecessary to attach any smoothing powder to it. When some solid smoothing powder such as talc is attached to it, however, its smoothness can be further enhanced. It is therefore desirable that some smoothing powder or agent is attached to the prepreg.

DETAILED DESCRIPTION OF THE PREFERRED EMBODIMENTS

Some embodiments of the present invention will be described with reference to the accompanying drawings.

First embodiment (Composite Rope of the Yarn-wrapped Type)

A first embodiment of the composite rope of the yarn-wrapped type and a method of manufacturing the same will be described in detail referring to FIGS. 1 through 8.

(I) Multifilament 2 consisting of 12,000 carbon filaments each having a diameter of 7 $\mu$m is wound (rove) by reel 1 while holding its filaments parallel to one another (Step 51). The whole sectional area of this multifilament 2 is 0.46 mm$^2$.

Figure 1:
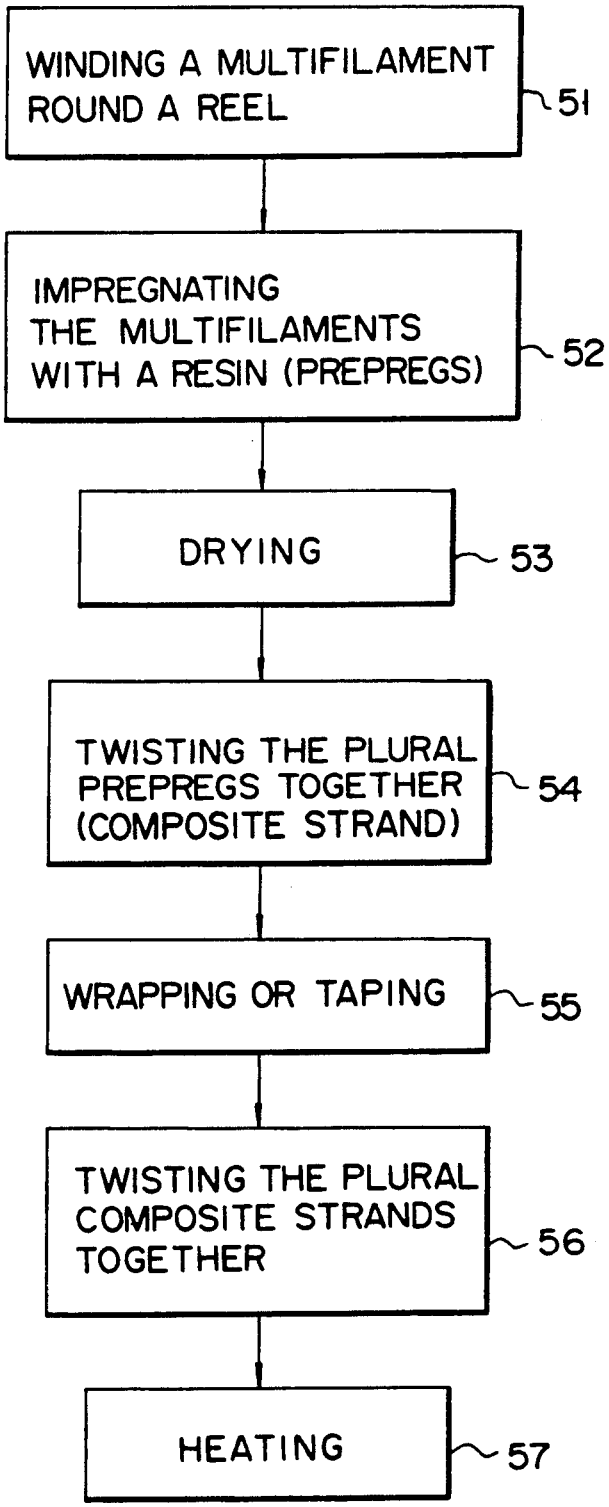
FIG. 1 is a flow chart showing a method of manufacturing a composite rope according to the present invention.
Figure 2:
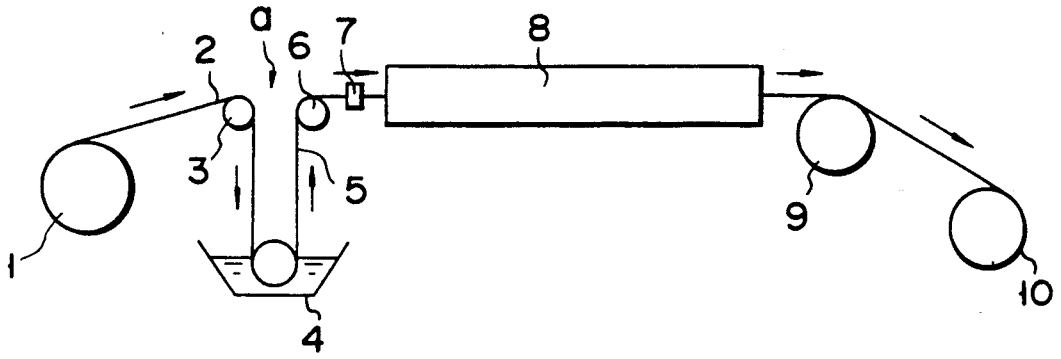
FIG. 2 shows a system for impregnating a multifilament with a resin and drying the resin-impregnated multifilament.

(II) Reel 1 is attached to a rotating shaft located on the supply portion of resin-impregnating device (a). As shown in FIG. 2, multifilament 2 is continuously fed from reel 1 into epoxy resin in resin vessel 4 over guide roller 3. Multifilament 2 is thus impregnated with epoxy resin to form prepreg 5 (Step 52).

Prepreg 5 is introduced into die 7 over guide roller 6. Excessive epoxy resin impregated in prepreg 5 is thus removed from prepreg 5. As the result, the amount of epoxy resin now impregnated becomes about 44 volume % and prepreg 5 is shaped to be circular in its cross section.

(III) Prepreg 5 is fed into drying chamber 8 and dried at 100° C. for five minutes (Step 53). Epoxy resin impregnated in prepreg 5 is thus half-set. After it is thus dried, prepreg 5 is guided over guide roller 9 and is wound by reel 10.

Figure 3:
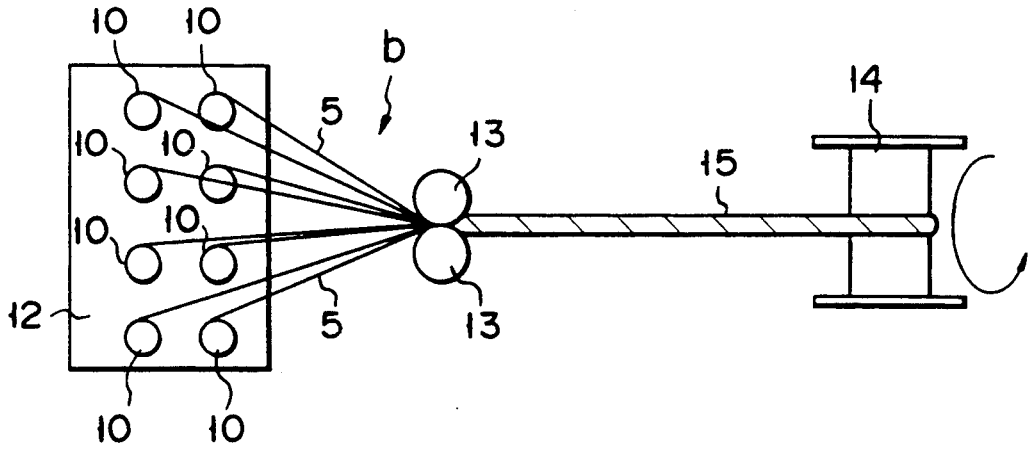
FIG. 3 shows a system for primarily-twisting prepregs.

(IV) As shown in FIG. 3, fifteen units of reels 10 are attached to rotating shafts on stand 12 of twisting device (b), and prepregs 5 on reels 10 are fed between paired bonding rollers 13. Fifteen strings of prepregs 5 are bonded together by half-set epoxy resin contained in prepregs 5. Prepregs 5 thus bonded together are twisted while being wound by reel 14 to form a composite strand (or primarily-twisted product) 15 (Step 54). Prepregs 5 bonded together are twisted in this case at a twisting pitch 90 mm (which corresponds to 22.5 times the diameter 4.0 mm of the finished strand).

Figure 4:
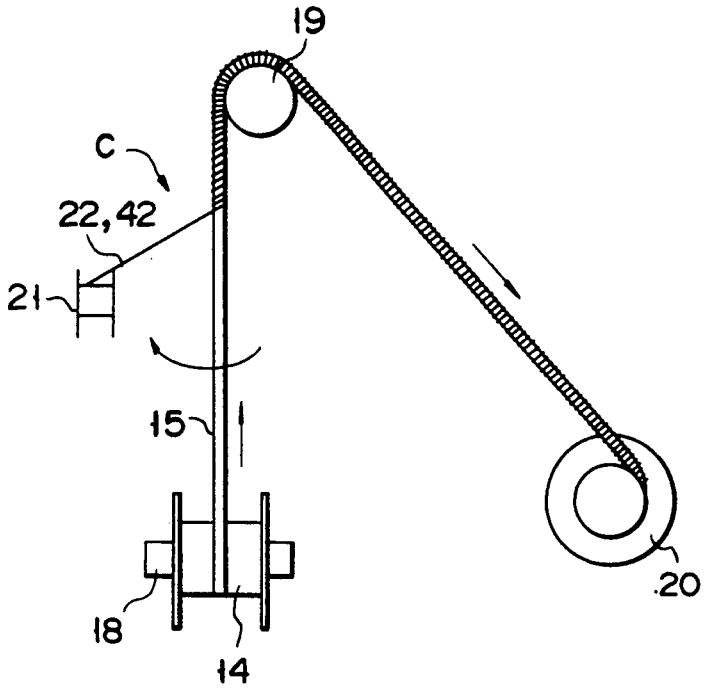
FIG. 4 shows a system for wrapping a multifilament or porous tape round a composite strand.

(V) As shown in FIG. 4, reel 14 is attached to shaft 18 of wrapping/coating device (c) and one end of composite strand 15 on reel 14 is attached to reel 20, passing over guide roller 19.

Wrapping/coating device means (c) is provided with spinning machine 21. Polyester multifilament (yarn) 22 having a diameter of 33 μm and a size of 8000 denier is wound up round spinning machine 21.

Yarn 22 is wound round composite strand 15 to closely wrap the outer circumference of strand 15, while feeding composite strand 15 from reel 14 to reel 20 at a certain speed and turning spinning machine 21 around composite strand 15 (Step 55).

Yarn 22 is wound at an angle of about 70° relative to composite strand 15 and in the normal direction in which strand 15 is twisted.

Figure 5:
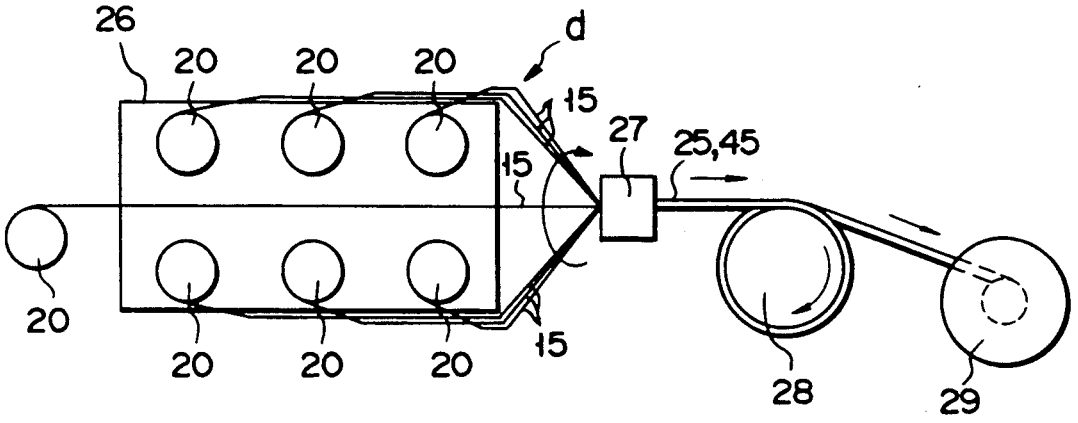
FIG. 5 shows a system for secondarily-twisting plural composite strands.

(VI) As shown in FIG. 5, turning member 26 is located behind guide member 27 of twisting device (d). This guide member 27 serves as a fixed guide for guiding plural composite strands 15. A unit of independent reel 20 is arranged behind turning member 26. The line along which composite strand 15 is fed from reel 20 is in accordance with the center axis of guide member 27.

While feeding composite strand 15 on independent reel 20 to guide member 27 and turning the turning means 26, six strings of composite strands 15 are supplied to guide member 27, converging upon the composite strand fed from independent reel 20. Six strings of composite strands 15 are turned in this case in a direction reverse to the direction in which composite strand 15 is twisted, and they are twisted at an angle whose tan $\theta$ is 5.8.

Figure 7:
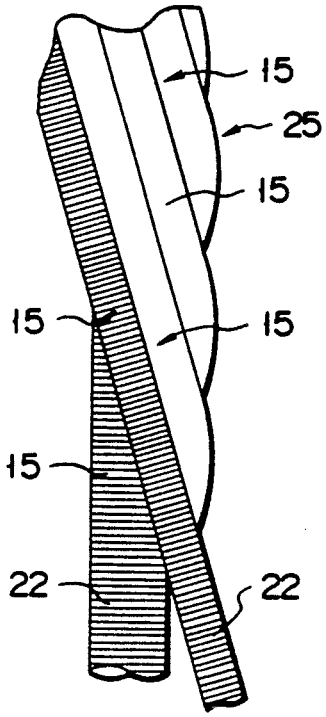
FIG. 7 is a front view showing composite rope of a first embodiment according to the present invention partly untied.
Figure 8:
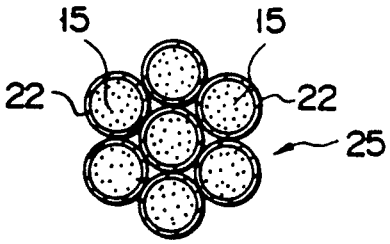
FIG. 8 is a sectional view showing the composite rope of the first embodiment.
Figure 9:
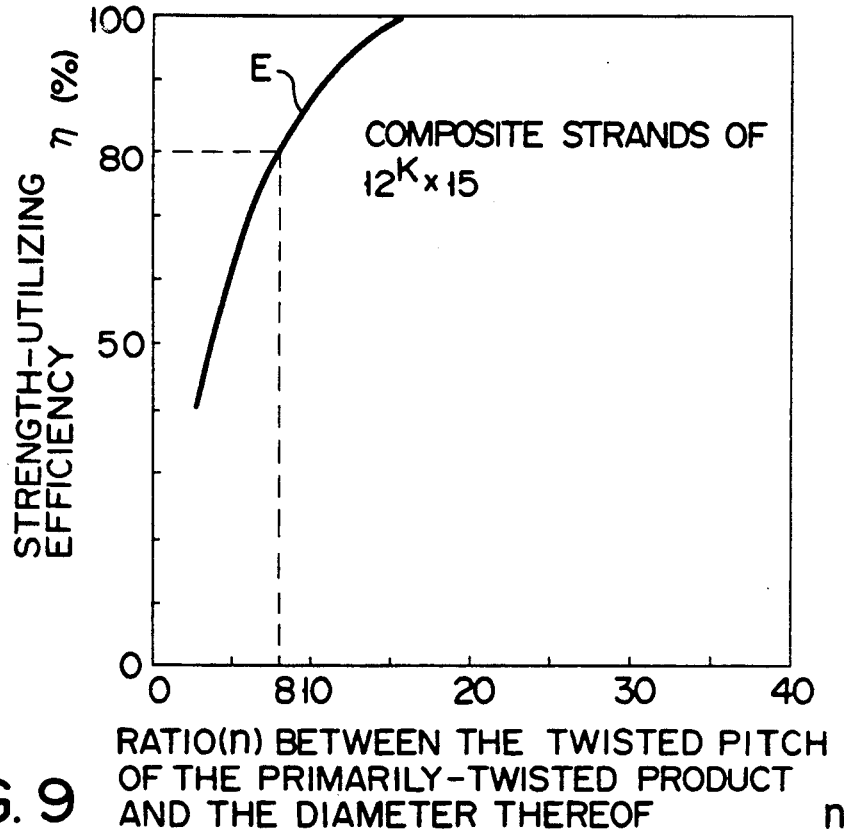
FIG. 9 is a graph showing the relation between ratio (n) of twisting pitch relative to diameter and strength-utilizing efficiency $\eta$ in the case of the secondarily-twisted product.
Figure 10:
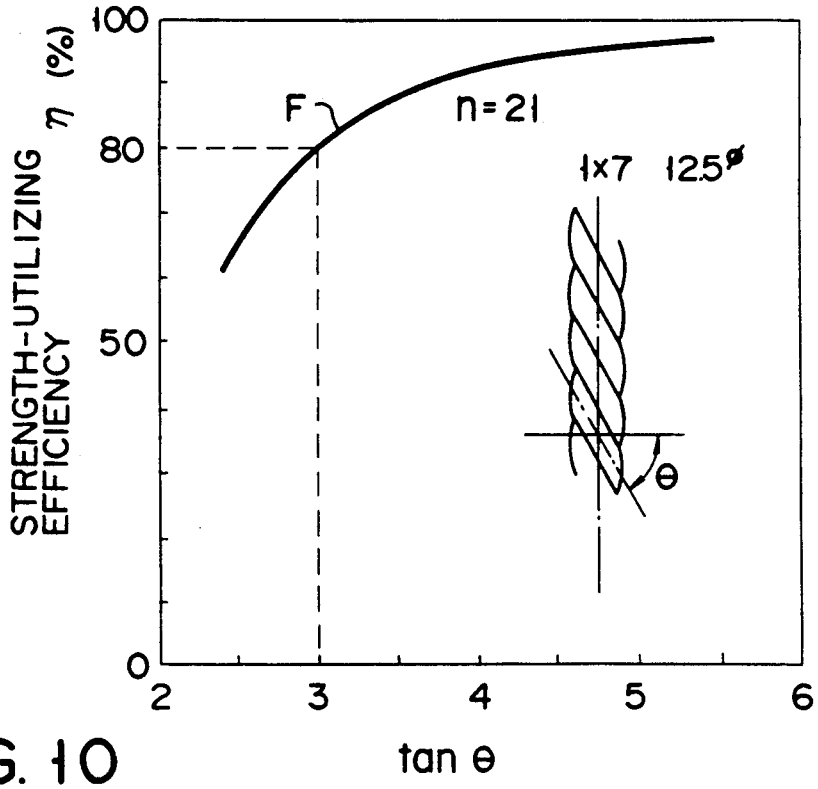
FIG. 10 is a graph showing the relation between tan $\theta$ and strength-utilizing efficiency $\eta$ in the case of the secondarily-twisted product.

As shown in FIGS. 7 and 8, six strings of composite strands 15 are twisted round a string of composite strand 15, which serves as the core of these six strings of composite strands 15 twisted, to thereby form secondarily-twisted product 25 which consists of seven strings of composite strands 15.

Secondarily twisted product 25 is pulled out of guide member 27 by means of capstan 28 and then wound by reel 29 (Step 56).

Figure 6:
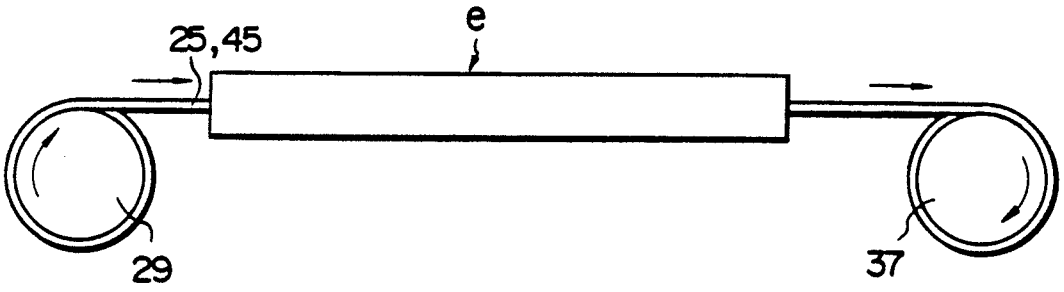
FIG. 6 shows a system for heating a secondarily-twisted product.

(VII) As shown in FIG. 6, secondarily-twisted product 25 is passed through heating device (e) and wound up by reel 37. Secondarily-twisted product 25 is heated at 130° C. for 90 minutes in heating device (e) (Step 57).

Half-set epoxy resin impregnated in composite strands 15 is completely set by this heating. Gas and solvent are escaped this time through yarn 22 wrapped round each of composite strands 15, leaving no void in any of strands 15. As the result, there can be provided a composite rope so excellent in mechanical properties as shown example 1 in Table 1.

In Table 1, a rope having a diameter of about 12.5 mm and formed by twisting seven strings of the composite strands was examined regarding to its various properties cited at items 2 through 8. The results thus obtained were compared with those of controls 1 through 3 in Table 1. Control 1 is a twisted PC steel rope prepared according to the standards of JIS G-3536, control 2 a conventional composite rope prepared according to the technique disclosed by U.S. Pat. No. 4,677,818 and control 3 a conventional composite rope prepared according to the technique disclosed by Japanese Patent Publication Sho 57-25679.

Regarding to concrete-adhesive strength cited at item 8 in Table 1, the ropes were examined under such a condition that they were practically used. Namely, the rope (formed by twisting seven strings of composite strands) is embedded in concrete whose compression strength is about 500 Kgf/cm$^2$. Force needed to pull the rope out of concrete is measured and divided by surface area A of the rope to obtain the concrete-adhesive strength of the rope. Considering that surface area of the rope which is contacted with concrete, it is assumed that an area which corresponds to two thirds of the surface area of six strings of composite strands twisted round a core strand is surface area A of the rope.

According to example 1, gas and solvent caught in each of the composite strands can be escaped through the yarn wrapped round each of the strands and the number of voids in the strands can be reduced to a great extent. This enables mechanical properties of the rope to be improved.

This prevention of voids occurrence can contribute a great deal to improving the strength-utilizing efficiency (at item 3 in Table 1) and tension fatigue characteristic (at item 6 in Table 1) of the rope.

Each of the composite strands is wrapped by the yarn. Therefore, this makes the composite rope slimmer. In other words, the composite rope of the present invention can be same in strength but much smaller in diameter, as compared with the conventional ones.

This reduction of the wrapping thickness can contribute a great deal to improving relaxation loss (at item 7 in Table 1) as well as enhancing breaking load (at item 2 in Table 1).

Yarn 22 is wound round each of composite strands 15 at an angle which is perpendicular to the strand. This increases the frictional resistance of the rope surface. When the composite rope is used as concrete-reinforcing material, therefore, its concrete-adhesive strength becomes 2.5–4.6 times those of the conventional ropes (controls 1 through 3).

When the composite rope of the present invention is examined after its concrete-adhesive test, concrete enters into recesses between adjacent parts of the wrapped yarn round each of the strands. It is believed that this is the reason why its concrete-adhesive strength can be enhanced to a great extent. In the case of control 2 (or composite rope disclosed by U.S. Pat. No. 4,677,818), however, a woven fabric (texture) is used to wrap each of the composite strands. Therefore, all of fibers of the woven fabric are not directed in a direction substantially perpendicular to the axis of the strand.

Second embodiment (Composite Rope of the Porous-Tape-wrapped Type)

A second example of the composite rope of the porous-tape-wrapped type and a method of manufacturing the same will be described in detail referring to FIGS. 1 through 6 and FIGS. 11 and 12. Description on the same parts of the second embodiment as those of the first one will be omitted.

According to the second embodiment of the present invention, each of composite strands 15 is wrapped and coated by porous tape 42. A sheet of unwoven fabric made of polyester staples is used as porous tape 42. Unwoven fabric of polyamide (e.g. aramide) maybe used instead. Porous tape 42 is 20 mm wide and 0.1 mm thickness.

As shown in FIG. 4, tape 42 is wound round composite strand 15 is at angle of 37° and a pitch of 17 mm in such a way that half of tape 42 in the width direction thereof is overlapped upon the other half thereof (Step 55).

Figure 11:
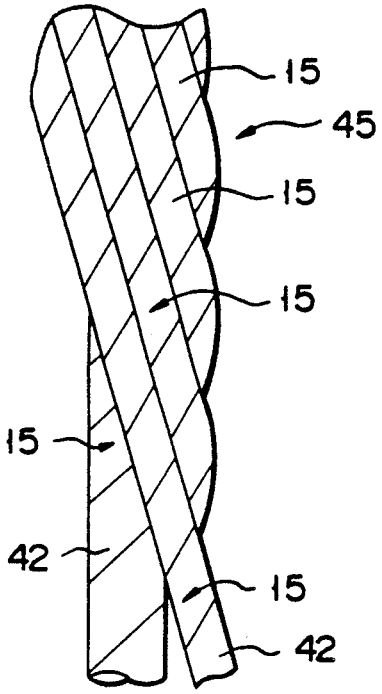
FIG. 11 is a front view showing composite rope of a second embodiment according to the present invention partly untied.
Figure 12:
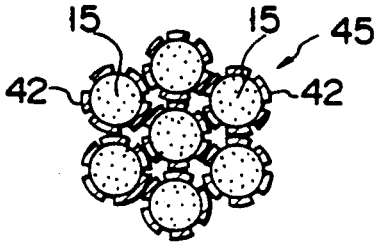
FIG. 12 is a sectional view showing the composite rope of the second embodiment.

As shown in FIG. 5, seven composite strands 15 each being thus taped are twisted together. Secondarily-twisted product 45 is thus formed, as shown in FIGS. 11 and 12 (Step 56).

As shown in FIG. 6, secondarily-twisted product 45 is heated at 130° C. for 90 minutes (Step 57). The half-set resin impregnated in secondarily-twisted product 45 is thus completely set to form a composite rope, high tensile strength and low elongation.

According to the second embodiment of the present invention, gas in each of composite strands 15 can be escaped through numerous holes of porous tape 42. This enables composite strand 15 not to have any void therein, so that properties of the composite rope can be improved.

According to the second embodiment, the composite rope can be made slimmer as compared with the conventional ones, because tape 42 wrapped round each of composite strands 15 is thin.

A composite rope having a larger diameter can be prepared using the first and the second embodiment of the composite rope as its core. More particularly, plural composite strands each containing a half-set resin are twisted round a composite rope which has been formed by seven composite strands to form a tertiarily-twisted product. This tertiarily-twisted product is heated to completely set the half-set resin impregnated in each of the outer composite strands.

When the above process is repeated using the heat-set tertiarily-twisted product as the core, biquadratically-, quintically- and further-twisted products can be formed to provide extremely big composite ropes.

According to the present invention as described above, there can be provided a composite rope excellent in strength-utilizing efficiency $\eta$, tension fatigue property and relaxation loss.

Further, rope strength per unit volume can be enhanced and the composite rope can be thus made slimmer as compared with the conventional ones.

Furthermore, the concrete-adhesive strength of the composite rope can be enhanced to a great extent by wrapping a yarn round each of the composite strands which are twisted to form the composite rope.

TABLE 1

| | EXAMPLE 1 | CONTROL 1 | CONTROL 2 | CONTROL 3 |
|---|---|---|---|---|
| ROPE FORMATION · DIAMETER | 1 × 7 12.5 mm Φ | 1 × 7 12.4 mm Φ | 1 × 7 12.5 mm Φ | 1 × 7 12.5 mm Φ |
| BREAKING LOAD (kgf) | 16,200 | 16,300 | 10,600 | 5,900 |
| STRENGTH-UTILIZING EFFICIENCY $\eta$ (%) | 95.0 | 97.0 | 71.9 | 65.2 |
| UNIT WEIGHT (g/m) | 151 | 729 | 144 | 128 |
| SPECIFIC STRENGTH (km) | 107.3 | 22.4 | 73.6 | 46.1 |
| TENSION FATIGUE LOAD (kgf) | 9,500 | 5,500 | 5,300 | 2,700 |
| RELAXATION LOSS (%) | 0.65 | 1.40 | 1.85 | 4.80 |
| CONCRETE-ADHESIVE STRENGTH (kgf/cm$^2$) | 73.7 | 29.1 | 27.2 | 16.0 |

What is claimed is:

1. A process for making a composite rope, comprising the following steps performed in the recited sequence:

(a) preparing a plurality of prepregs which are formed by impregnating a multifilament with a thermosetting resin and half-setting the resin impregnated in the multifilament;

(b) twisting the prepregs together to form a primarily-twisted product;

(c) wrapping and tightly bonding the primarily-twisted product with a selected one of a yarn or a porous tape;

(d) twisting a plurality of primarily-twisted products together to form a secondarily-twisted product; and (e) heating said secondarily-twisted product to set the resin.

2. The process for making a composite rope according to claim 1 whereby plural yarns are simultaneously wound round the primarily-twisted product.

3. The process for making a composite rope according to claim 1 whereby smoothing agent is attached to each of the prepregs and these prepregs are twisted together to form a primarily-twisted product.

4. The process for making a composite rope according to claim 1, further comprising the step of making said yarn of organic or inorganic multifilament.

5. The process for making a composite rope according to claim 1, further comprising the step of making said yarn of polyester, polyamide or carbon multifilament.

6. The process for making a composite rope according to claim 1, further comprising the step of forming said yarn to have a diameter of 5–50 μm or a size of 2,000–15,000 denier.

7. The process for making a composite rope according to claim 1, wherein said wrapping step comprises wrapping said yarn around the primarily-twisted product at an angle of 50°–85° relative to the axis of such product.

8. The process for making a composite rope according to claim 1, further comprising the step of making said multifilament of one or more filaments selected from carbon, silicon carbide, glass and polyvinyl alcohol filaments.

9. The process for making a composite rope according to claim 1, further comprising the step of making said thermosetting resin from one or more resin selected from epoxy, unsaturated polyester, polyamide and bismaleimide resins.

10. The process for making a composite rope according to claim 1, wherein said twisting step (b) comprises twisting the prepregs together such that a ratio (n) of the twist pitch relative to the diameter of the primarily twisted product is larger than 8.

11. The process for making a composite rope according to claim 1, wherein said twisting step (b) comprises twisting the prepregs together such that tan $\theta$ is larger than 3, wherein $\theta$ is a twisting angle defined between an axis of a primarily-twisted product and a line perpendicular to the axis of the composite rope.

12. The process for making a composite rope according to claim 1, wherein said twisting step (d) comprises twisting said plurality of primarily-twisted products around a secondarily-twisted product in which the impregnated resin has been completely set and which serves as a core, and then applying heat to the composite rope to completely set the half-set resin impregnated in the primarily-twisted products.

13. The process for making a composite rope according to claim 1, further comprising the step of making the porous tape from a sheet of unwoven fabric made of polyester or polyamide staples.

14. The process for making a composite rope according to claim 1, further comprising the step of making the porous tape to have a thickness in the range of 0.01 to −0.30 mm.

15. The process for making a composite rope according to claim 1, wherein the wrapping step comprises winding the porous tape around the primarily-twisted product such that half its width overlaps its other half.

* * * * *